US011787628B2

(12) United States Patent
Ye

(10) Patent No.: US 11,787,628 B2
(45) Date of Patent: Oct. 17, 2023

(54) SMART TRASH CAN

(71) Applicant: Guangdong Willing Technology Corporation, Guangdong (CN)

(72) Inventor: Jingnong Ye, Huizhou (CN)

(73) Assignee: GUANGDONG WILLING TECHNOLOGY CORPORATION, Guangdong (CN)

( * ) Notice: Subject to any disclaimer, the term of this patent is extended or adjusted under 35 U.S.C. 154(b) by 101 days.

(21) Appl. No.: 17/574,560

(22) Filed: Jan. 13, 2022

(65) Prior Publication Data

US 2023/0219748 A1 Jul. 13, 2023

(51) Int. Cl.
*B65D 43/26* (2006.01)
*B65F 1/06* (2006.01)
*B65F 1/16* (2006.01)

(52) U.S. Cl.
CPC ..... *B65F 1/06* (2013.01); *B65F 1/16* (2013.01); *B65F 2210/167* (2013.01); *B65F 2210/168* (2013.01)

(58) Field of Classification Search
CPC .. B65F 1/06; B65F 1/16; B65F 1/1623; B65F 2210/167; B65F 2210/168
USPC ..... 220/495.01, 495.05, 495.06, 495.08, 220/908.1
See application file for complete search history.

(56) References Cited

U.S. PATENT DOCUMENTS 8,984,847 B1 * 3/2015 Nguyen ..... B65F 1/062 53/567
2006/0010837 A1 * 1/2006 Jurus ..... B65F 1/062 53/436
2019/0381747 A1 * 12/2019 Qiu ..... B29C 66/4312

FOREIGN PATENT DOCUMENTS

CN 112607261 * 1/2021 ..... B65F 1/16

* cited by examiner

*Primary Examiner* — John K Fristoe, Jr.
*Assistant Examiner* — Elizabeth J Volz
(74) *Attorney, Agent, or Firm* — Leong C. Lei

(57) ABSTRACT

The trash can includes a can member, a fastener member for fixing a trash bag's opening, a hoist member, and a thermal sealing member mounted on the can member. The fastener member is detachably embedded in the thermal sealing member, the hoist member engages the thermal sealing member into vertical movement. The can member is also configured with a pump element, a sensor element, a power element, and a controller element. The trash bag is stretched open on the fastener member. The pump element draws air out of the can member and the trash bag is automatically expanded. The sensor element detects that the trash bag has expanded and the pump element stops pumping. The hoist member moves the fastener member upward to further expand the trash bag. The thermal sealing member automatically shrinks and seals the opening of the trash bag.

10 Claims, 12 Drawing Sheets

SMART TRASH CAN

BACKGROUND OF THE INVENTION

(a) Technical Field of the Invention

The present invention is generally related to trash cans, and more particular to a smart trash can.

(b) Description of the Prior Art

Garbage or trash is part of people's daily life. Waste processing, be it liquid or solid waste, concerns everyone, from government officials to individual persons.

Households, corporations, and public places all have trash cans to collect various kinds of trashes. Usually trash bags are installed in the trash cans so that, when the trash cans are full, only the trash bags are disposed and the trash cans may be reused immediately after putting in new trash bags.

The repeated replacement of trash bags not only is inconvenient, but also often makes the handlers uncomfortable as they are first-handedly in touch with the filth or smell of the trash.

SUMMARY OF THE INVENTION

A major objective of the present invention is to enhance the convenience and sanitation of a trash can by providing automatic installation, sealing, and enlarging the trash bag.

To achieve the objective, the trash can includes a can member, a fastener member for fixing a trash bag's opening, a hoist member inside the can member arranged along an inner lateral side of the can member, a pump element inside a lower section of the can member, a sensor element inside the can member for detecting whether a lower part of the trash bag has approached a bottom side of the can member, a thermal sealing member mounted to a top opening of the can member for thermally sealing the opening of the trash bag, a power element on the can member, and a controller element inside the thermal sealing member electrically connected with the hoist member, the pump element, and the thermal sealing member. The fastener member is detachably embedded in the thermal sealing member, the hoist member is joined to a bottom side of the fastener member and engages the thermal sealing member into vertical movement.

To install a trash bag, the opening of the trash bag is stretched open on the fastener member. Then, the controller element activates the pump element to draw air out of the can member and the trash bag is automatically expanded to a bottom side of the can member. The sensor element detects that the trash bag has reached the bottom side of the can member, and the controller element deactivates the pump element automatically. As such, the trash bag is automatically expanded without a user's manually expanding the trash bag into the can member, thereby enhancing the trash can's convenience.

When the trash bag is about full, the hoist member moves the fastener member upward to further expand the trash bag to accommodate more trash. To pack the trash bag, the thermal sealing member automatically shrinks and seals the opening of the trash bag so that the trash bag can be removed directly, thereby preventing the user from manual packaging the trash bag and reducing his/her chance of contacting the trash inside. The trash can therefore provide enhanced convenience and sanitation over the prior art.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
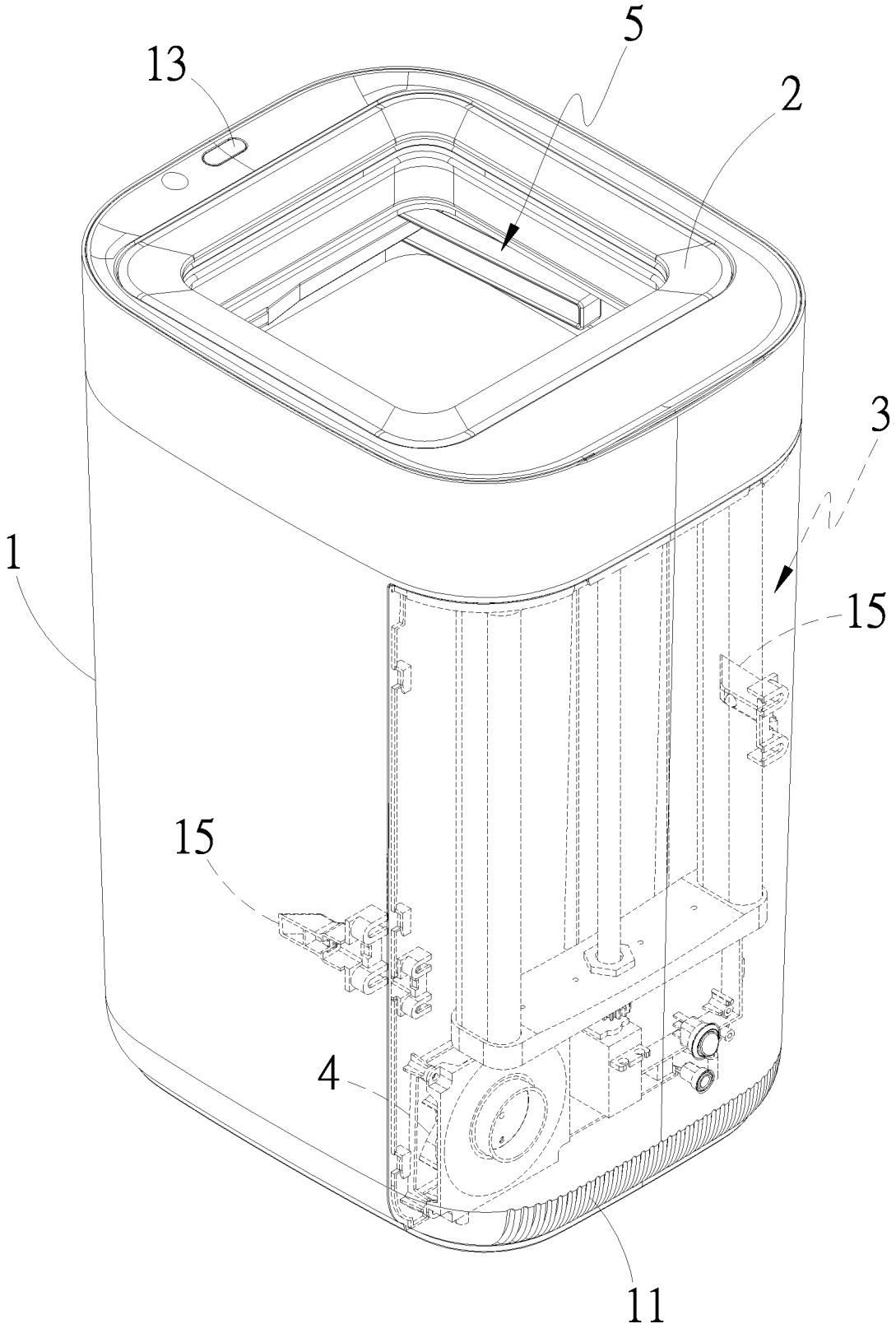
FIG. 1 is a perspective diagram showing a smart trash can according to a first embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 4, a smart trash can according to a first embodiment of the present invention includes:

a hollow can member 1;

a fastener member 2, where the fastener member 2 includes a ring-shaped prop element 21, and a correspondingly shaped seal element 22 joined to a top side of the prop element 21;

a hoist member 3 inside the can member 1 arranged along an inner lateral side of the can member 1, where the hoist member 3 includes a main shaft 31, a driver element 32 coupled to and engaging the main shaft 31 into vertical movement, a number of auxiliary shafts 33 arranged to two sides of the main shaft 31;

a pump element 4 inside a lower section of the can member 1, where a vent opening 11 is provided on the can member 1 adjacent to the pump element 4;

a sensor element 15 inside the can member 1, where in the present embodiment the sensor element 16 is an infrared sensor;

a ring-shaped thermal sealing member 5 mounted to a top opening of the can member 1, where the fastener member 2 is detachably embedded in the thermal sealing member 5, the hoist member 3 is joined to a bottom side of the fastener member 2, and the thermal sealing member 5 includes an elongated first sealing element 51 arranged adjacent to the hoist member 3, a sliding rod 53 perpendicular to the first sealing element 51, a second sealing element 52 opposite and parallel to the first sealing element 51 movable along the sliding rod 53, a first swivel arm 55 whose back end is pivoted to and engaged by a motor (not numbered) located oppositely to the first sealing element 51, and a second swivel arm 54 whose back end is pin-joined to a front end of the first swivel arm 55, where the second swivel arm is coupled to the second sealing element 52. When the first swivel arm 55 is turned by the motor, the second sealing element 52 is moved along the sliding rod 53 towards or away from the first sealing element by the second swivel arm 54. An elastic element 56 is configured at where the first swivel arm 55 and the second swivel arm 54 are joined;

a power element 12 on the can member 1, where in the present embodiment the power element 12 is a power connection socket on the can member 1; and a controller element 13 inside the thermal sealing member 5 electrically connected with the hoist member 3, pump element 4, and thermal sealing member 5.

The operation of the above-described components of the smart trash can is explained in details as follows.

Figure 5:
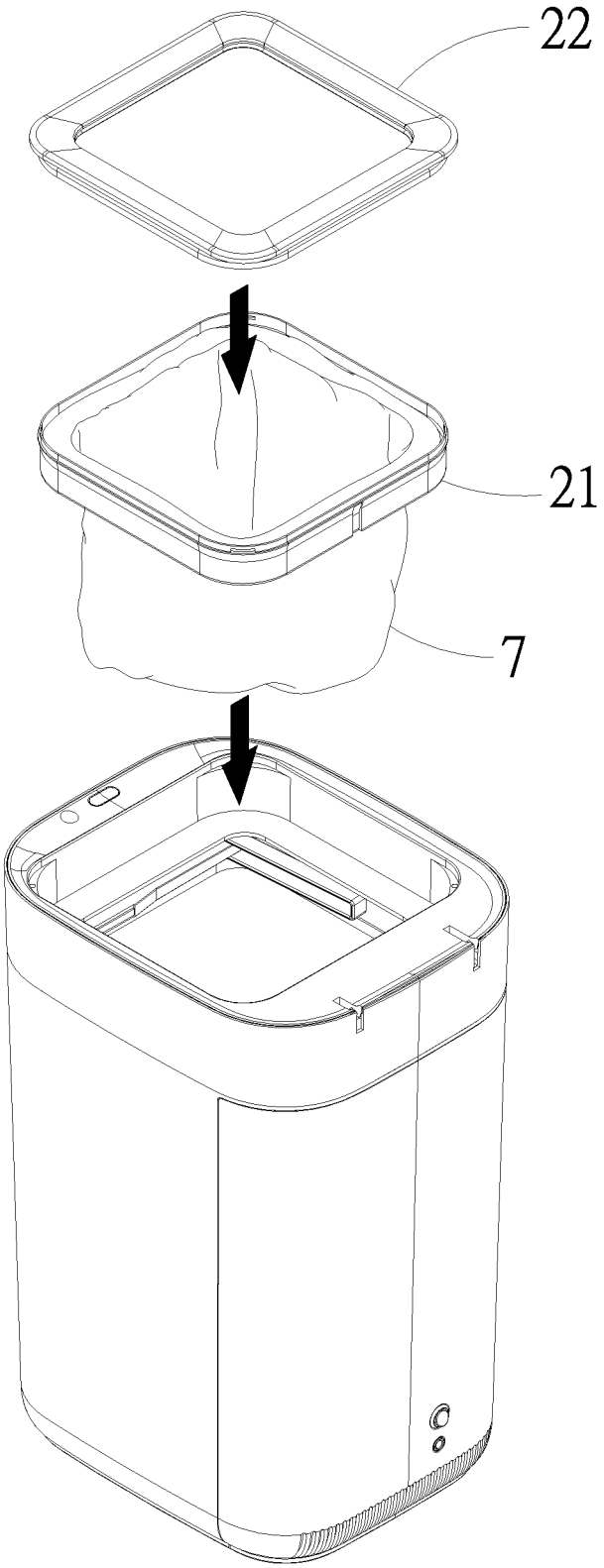
FIG. 5 is a perspective diagram showing the installation of a trash bag into the smart trash can of FIG. 1.

As shown in FIG. 5, to install a trash bag 7 in the smart trash can, the seal element 22 is first removed from the fastener member 2. The trash bag 7 is then placed inside the can member 1 with the trash bag 7's opening stretched onto the prop element 21. The seal element 22 is then restored to fixedly position the trash bag 7's opening in an open state.

Figure 6:
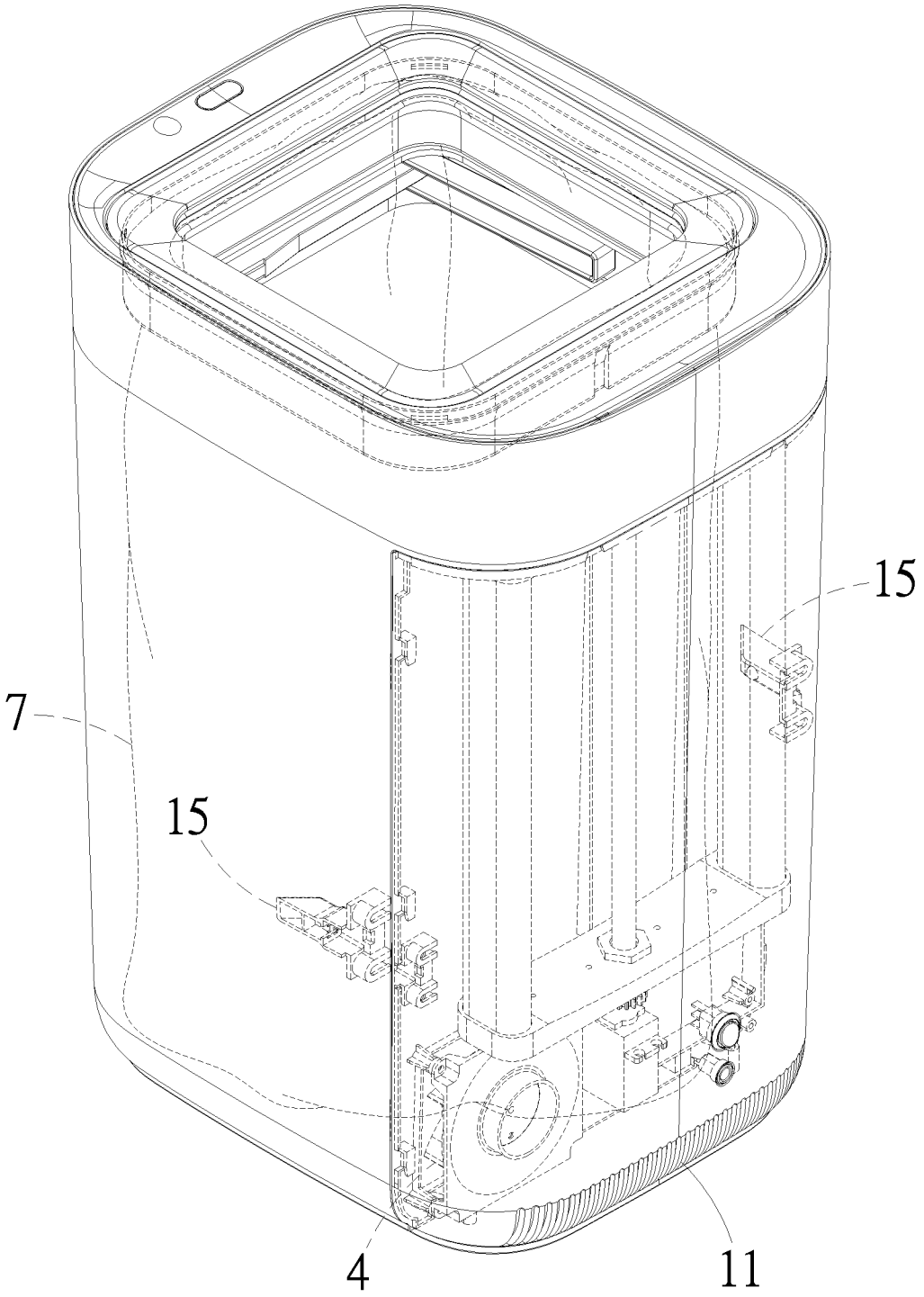
FIG. 6 is a perspective diagram showing the automatic expansion of a trash bag by the smart trash can of FIG. 1.

The power element 12 is then connected to an external power supply and the controller element 13 activates the pump element 4, as shown in FIG. 6, to draw air from the can member 1 out through the vent opening 11. A lower part of the trash bag 7 is as such automatically attached to the lower section of the can member 1. During the air drawing process, the sensor element 15 detects whether the lower part of the trash bag has reached the lower section of the can member 1. In the present embodiment, the sensor element 15 finds that the trash bag 7 has reached the lower section of the can member 1 as the trash bag 7 blocks the infrared sensing of the sensor element 15. The pump element 4 is then deactivated automatically by the controller element 13. As described, a user does not need to manually expand the trash bag 7 into the can member 1, providing significant usage convenience.

Figure 2:
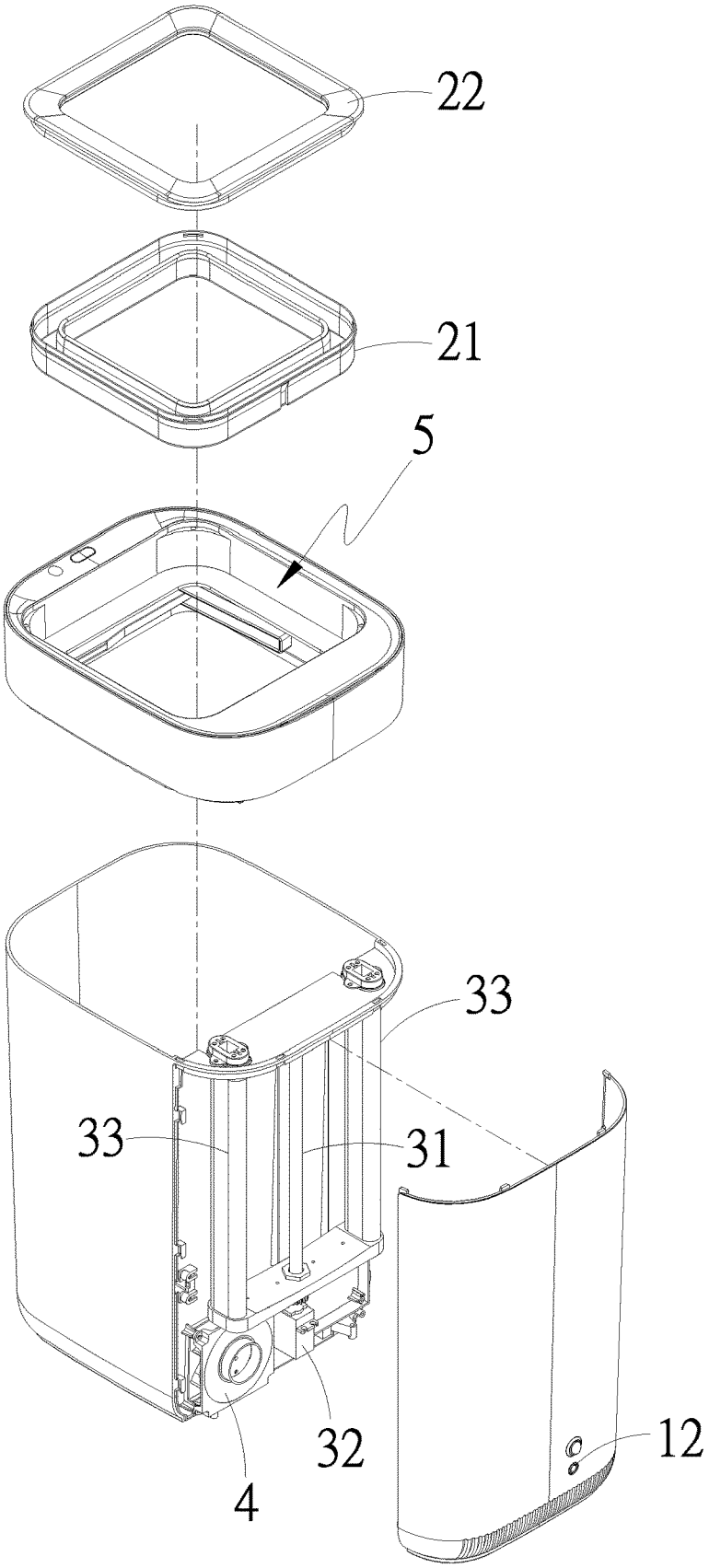
FIG. 2 is a perspective breakdown diagram showing the smart trash can of FIG. 1.
Figure 3:
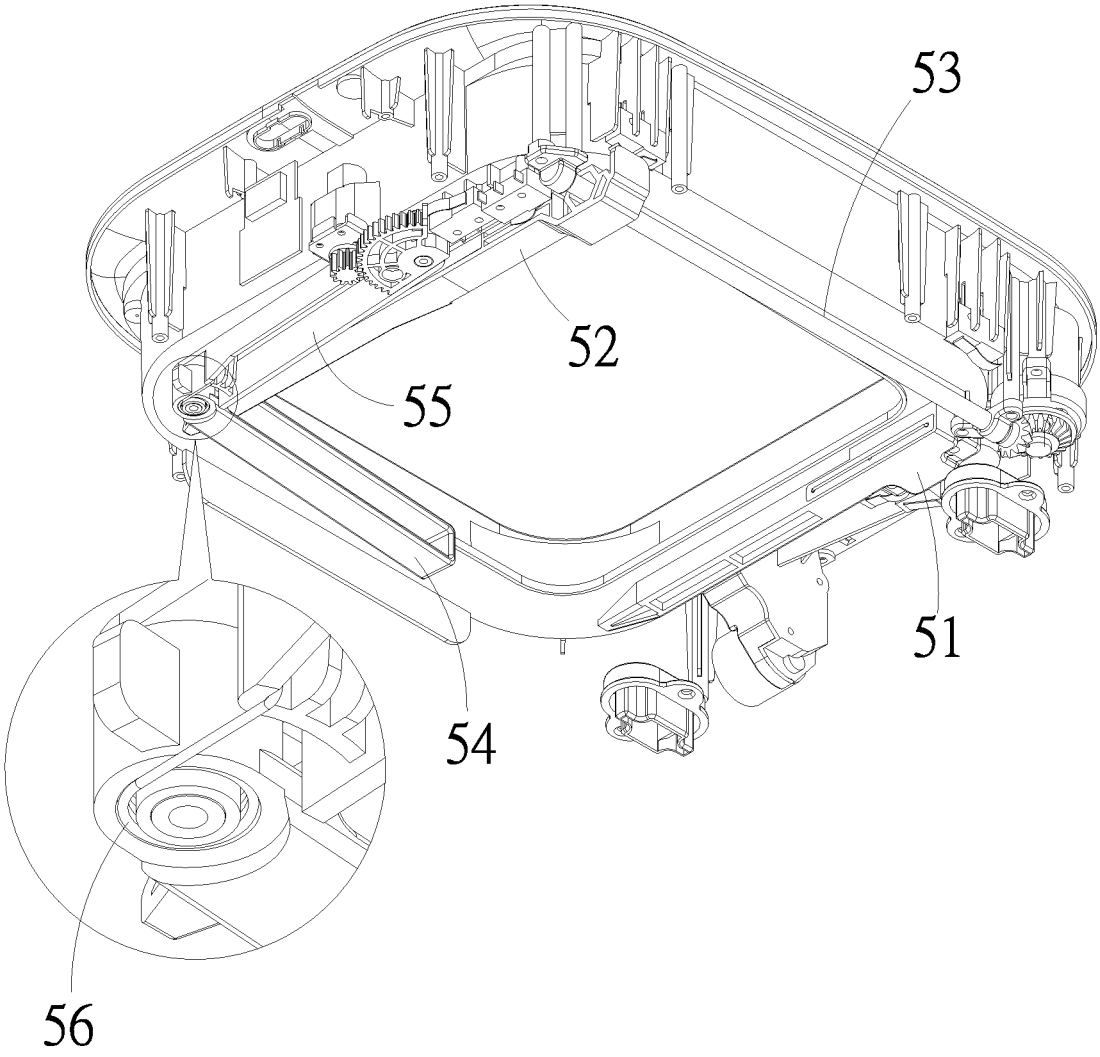
FIG. 3 is a perspective diagram showing a thermal sealing member of the smart trash can of FIG. 1.
Figure 4:
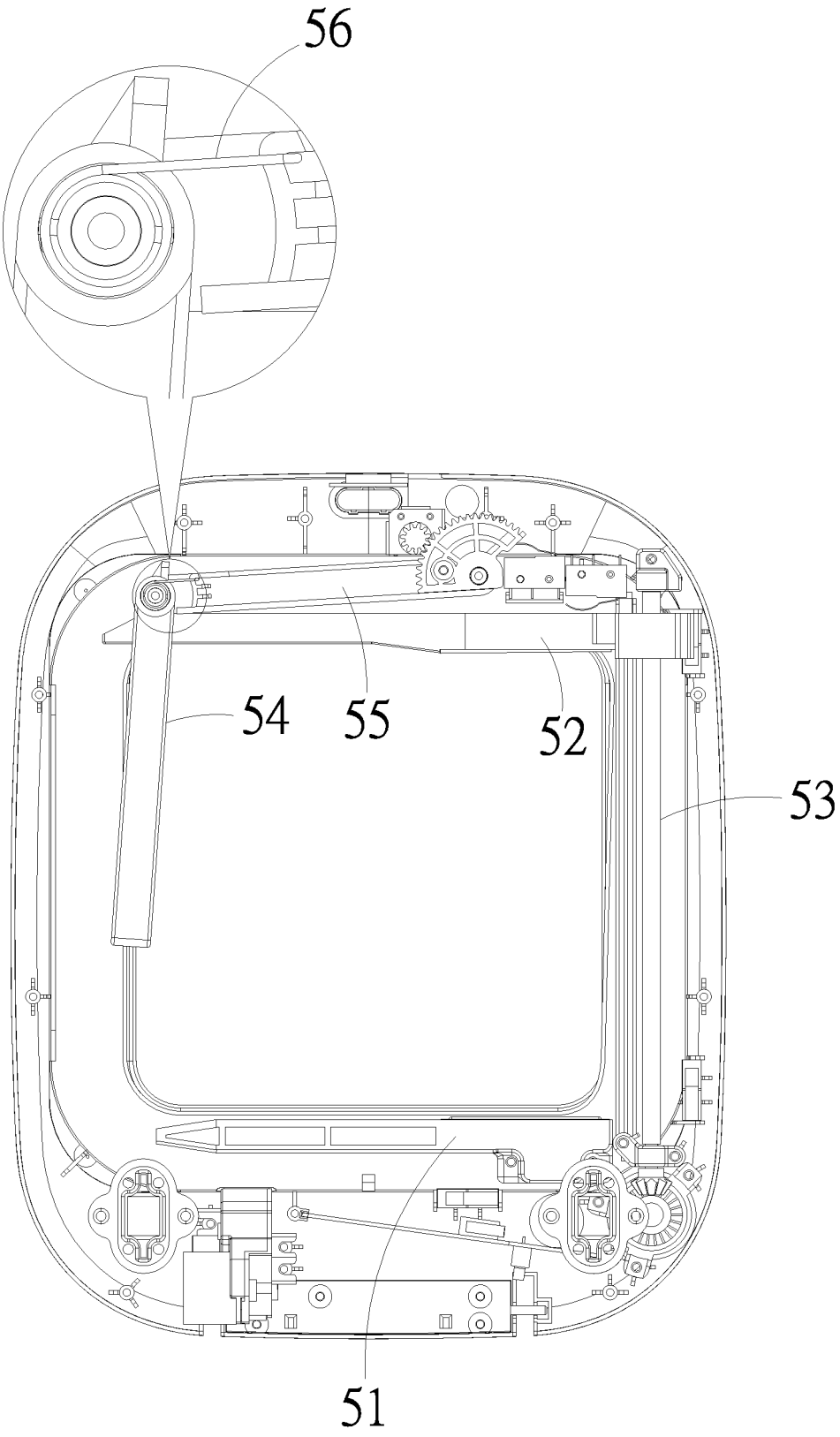
FIG. 4 is a top-view diagram showing the thermal sealing member of FIG. 3.
Figure 7:
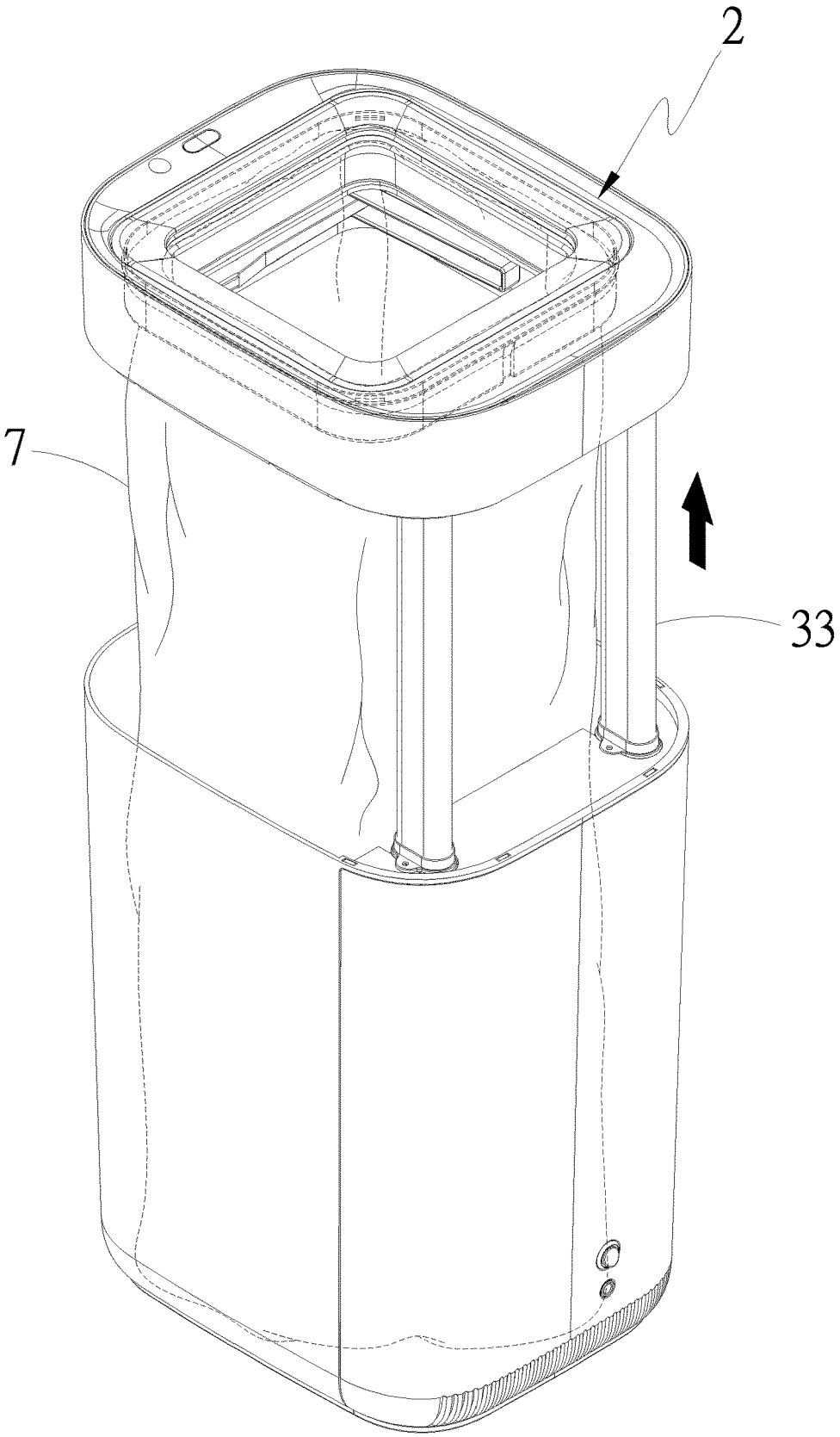
FIG. 7 is a perspective diagram showing the dynamic expansion of a trash bag by the smart trash can of FIG. 1.

If the trash bag 7 has a greater capacity than that of the can member 1, to better utilize the capacity of the trash bag 7, the controller element 13 engages the hoist member 3 where the driver element 32 raises the main shaft 31 vertically upward so that the trash bag 7 is expanded, as shown in FIGS. 1, 2, and 7. The upward lift of the main shaft 31 is stabilized by the auxiliary shafts 33 besides the main shaft 31 to prevent the trash bag 7 from tilting and prevent the trash inside the trash bag 7 from spilling out.

Figure 8:
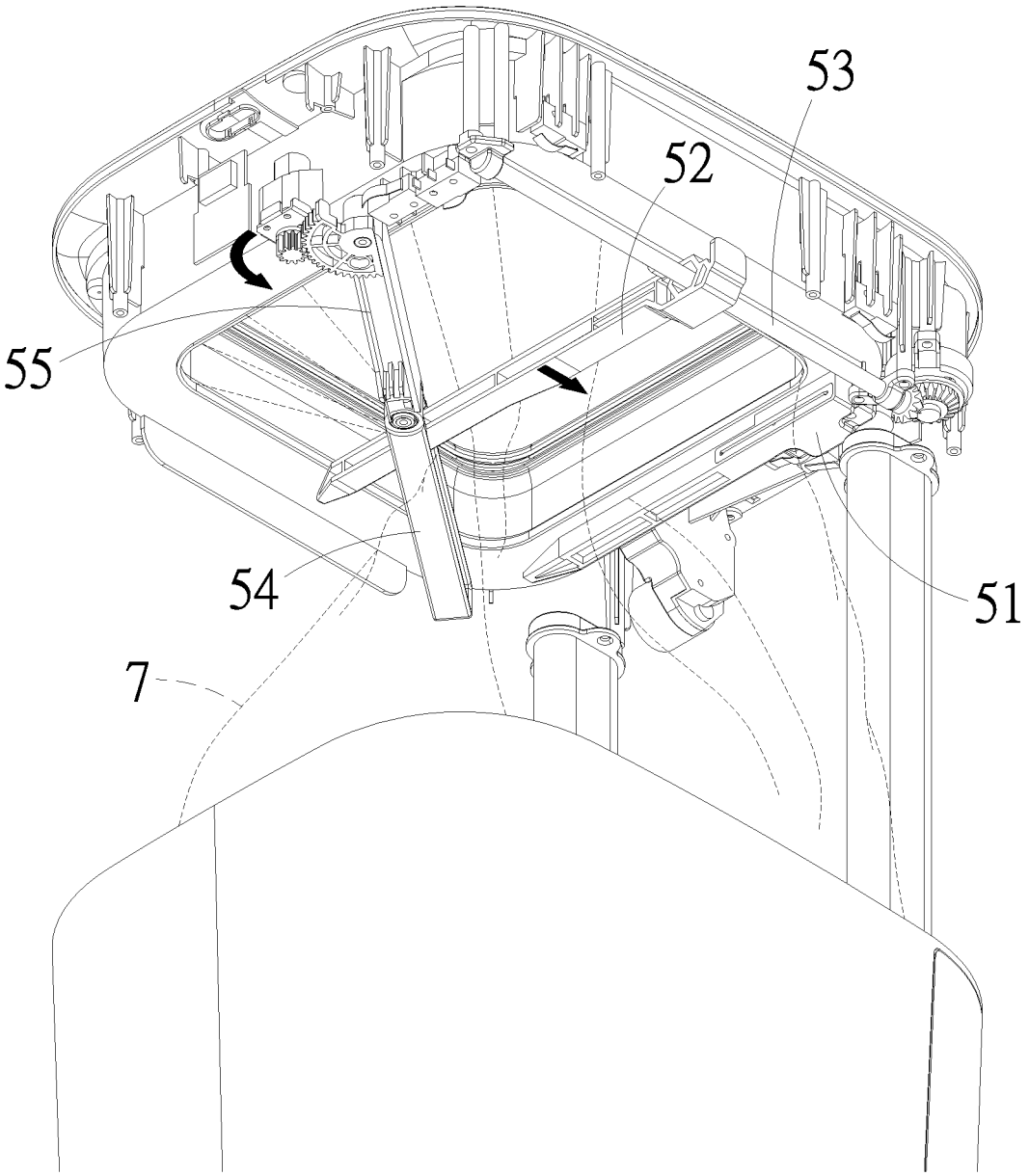
FIG. 8 is a perspective diagram showing the thermal sealing of a trash bag by the smart trash can of FIG. 1.
Figure 9:
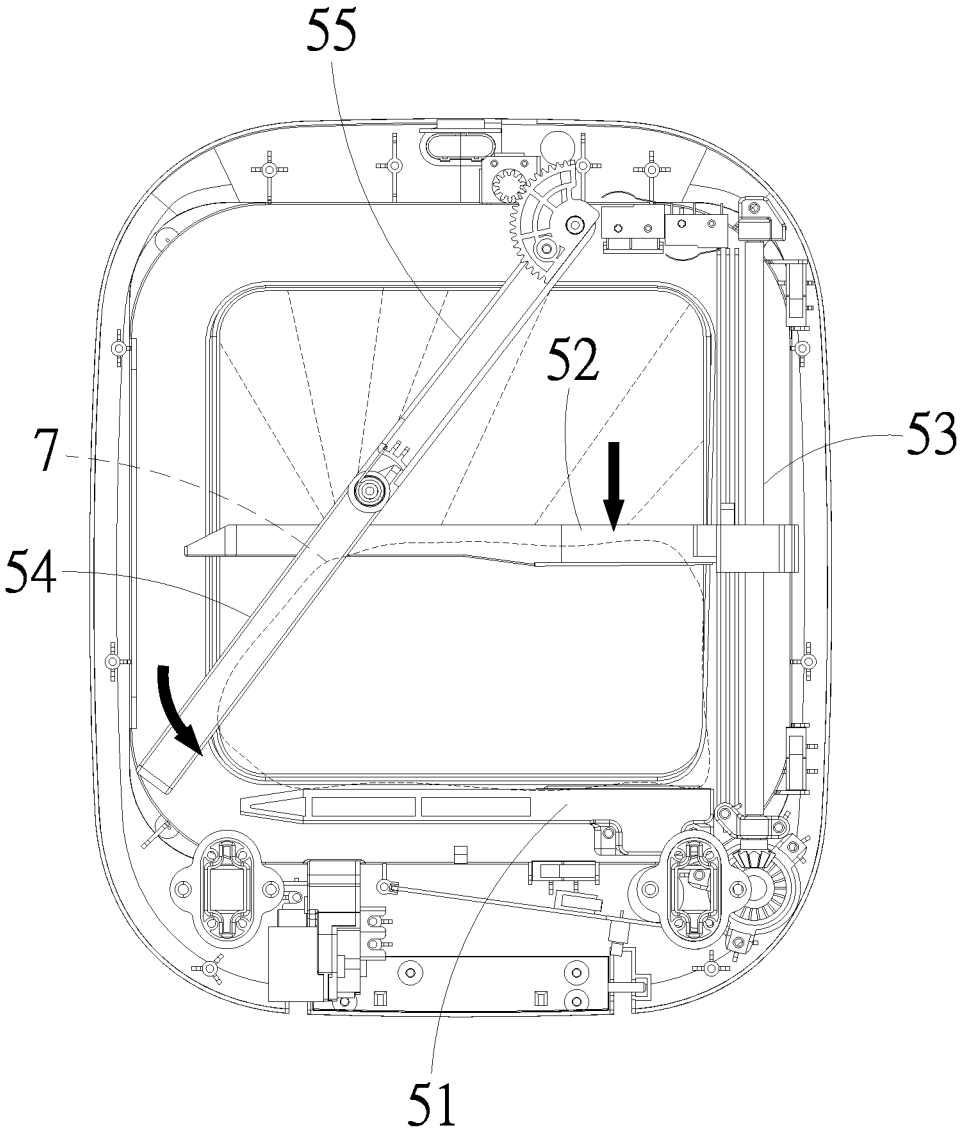
FIG. 9 is a topview diagram showing the thermal sealing of a trash bag by the smart trash can of FIG. 1.
Figure 10:
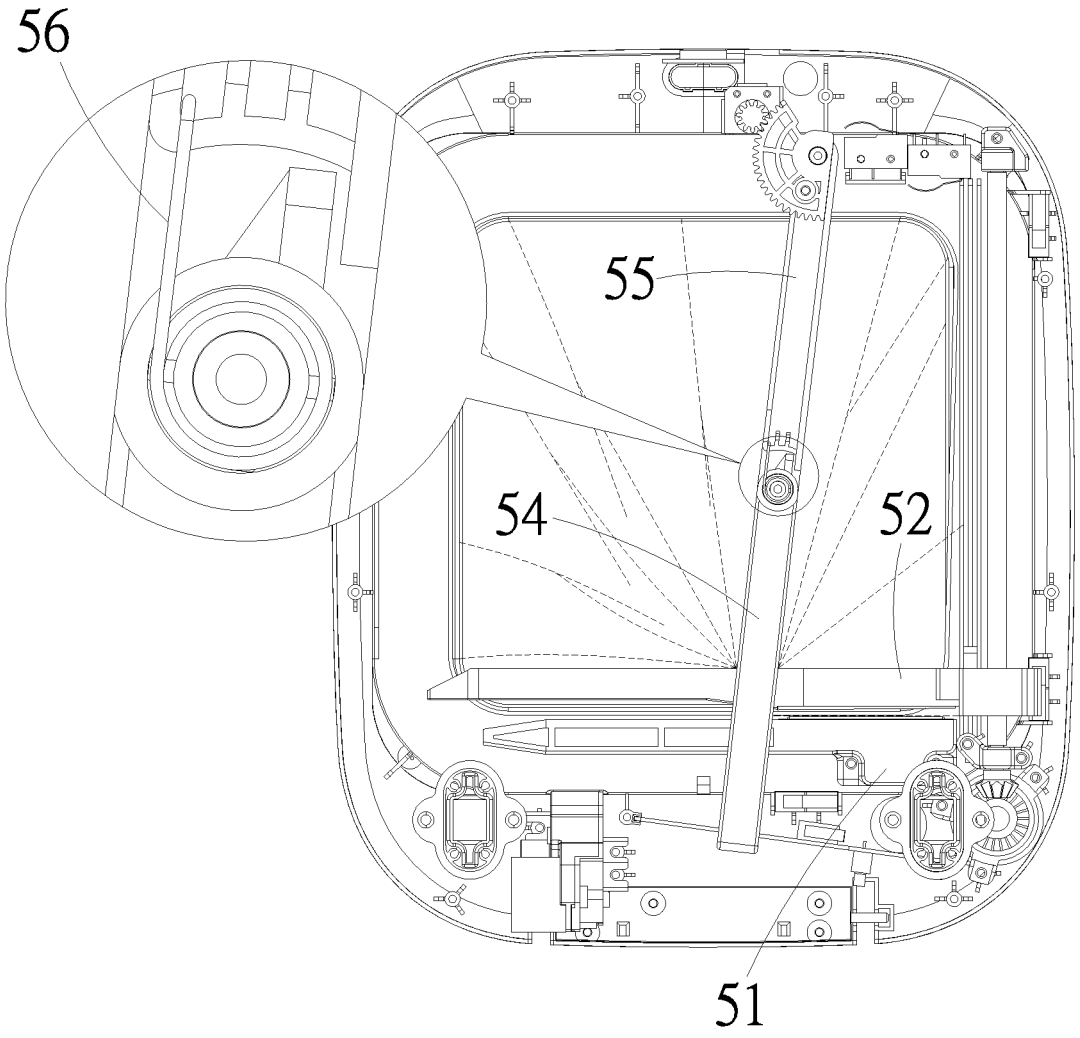
FIG. 10 is another top-view diagram showing the thermal sealing of a trash bag by the smart trash can of FIG. 1.

When the trash bag 7 is full and needs to be disposed, the thermal sealing member 5 automatically seals the opening of the trash bag 7. As shown in FIGS. 8 to 10, the second sealing element 52 approaches the first sealing element 51 along the sliding rod 53 as the first swivel arm 55, as well as the second swivel arm 54, is turned by the motor. The opening of the trash bag 7 is as such shrunk. The first and second sealing elements 51 and 52 then conduct thermal sealing to the opening of the trash bag 7 with enhanced effect. After the thermal sealing is finished and the sealed trash bag 7 is removed, the second sealing element 52 and the first swivel arm 55 are restored to their original positions. The elasticity of the elastic element 56 between the first swivel arm 55 and the second swivel arm 54 also helps to restore the second swivel arm 54 to its original position. Then, a new trash bag 7 may be installed in the can member.

As described above, the smart trash can expand the trash bag 7 by drawing air from the can member, selectively raises the trash bag 7 to fully utilize its capacity, and automatically sealing the trash bag 7 for convenient handling the trash bag 7 without touching the trash inside, thereby significantly enhancing the efficiency and sanitation of waste processing.

Figure 11:
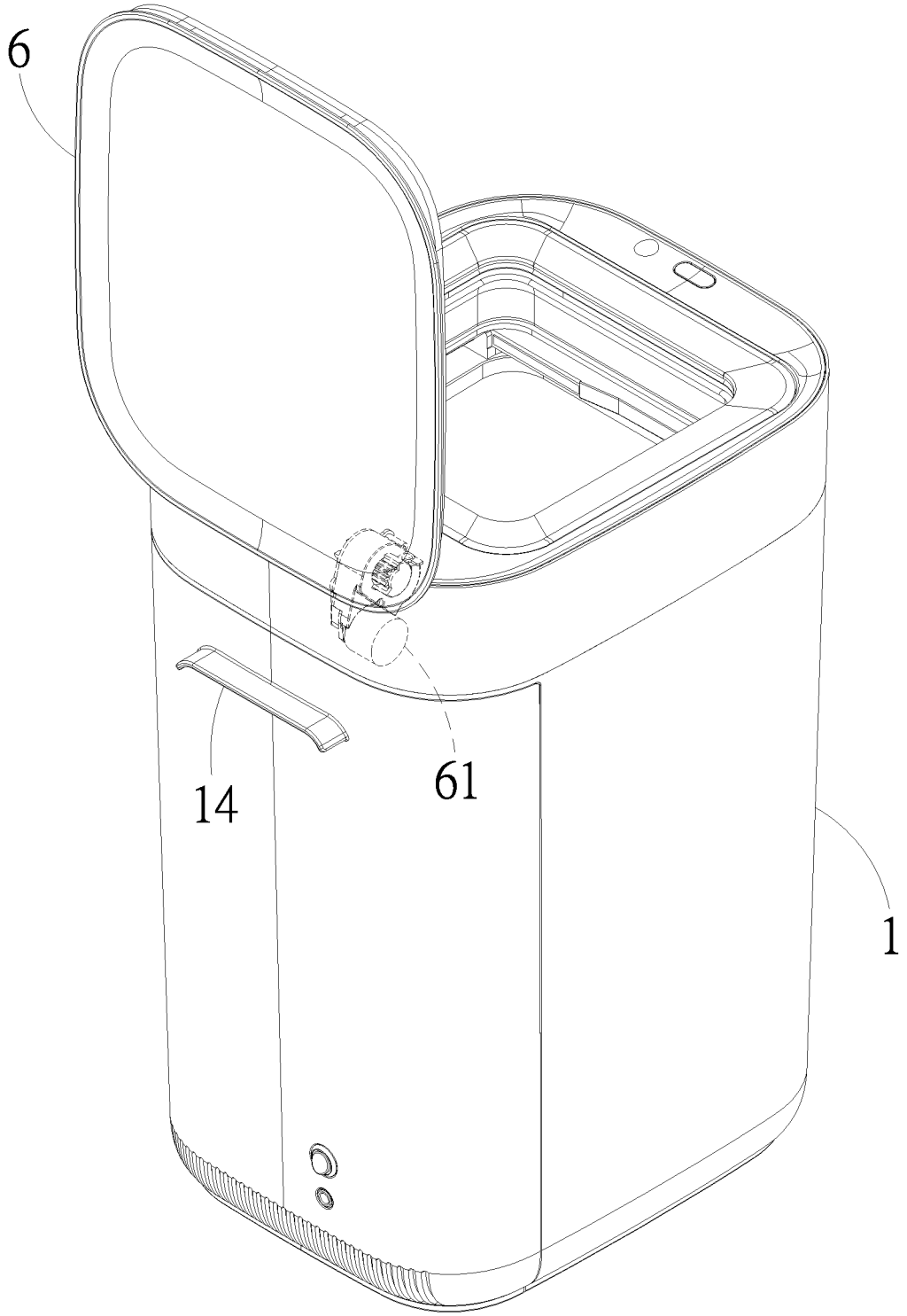
FIG. 11 is a perspective diagram showing a smart trash can according to a second embodiment of the present invention.

As shown in FIG. 11, a second embodiment of the smart trash bag is similar to the previous embodiment except that, the present embodiment further includes a cover 6 and a handle 14 on the can member 1. The cover 6 is hinged to the thermal sealing member 5 through a self-opening member 61. In the present embodiment, the self-opening member 61 includes gears, toothed disc, and motor. The motor engages gears which in turn drive the toothed disc to open or close the cover 6. As such, the cover 6 may normally cover the trash bag to shield the unpleasant odor of the trash and may be automatically opened by the self-opening member 61 for collecting trash, reducing the chance of contacting the trash directly.

The handle 14 is configured to an outer side of the can member 1 for easier and more reliable movement of the smart trash and preventing the spilling out of the trash inside.

Figure 12:
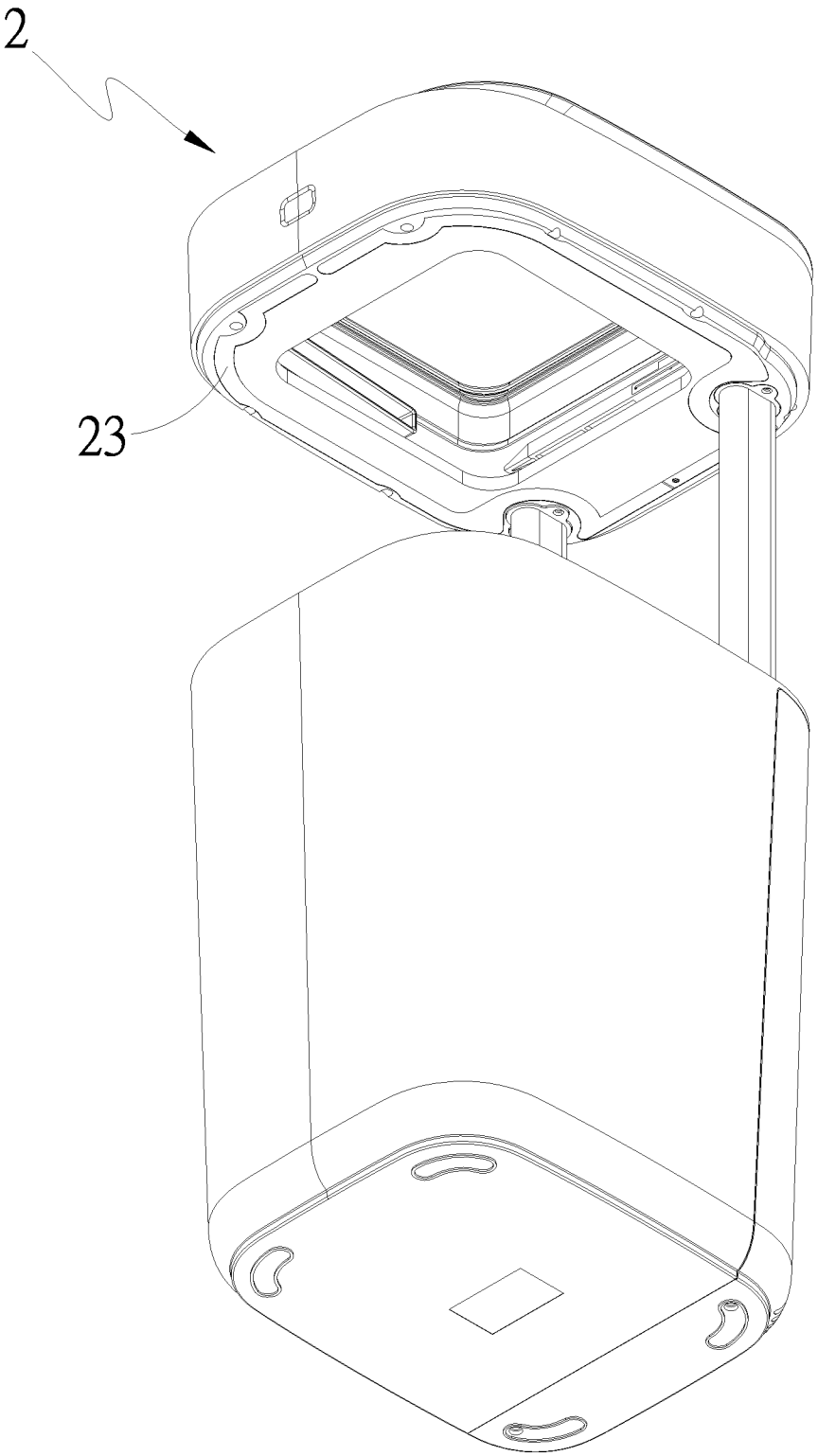
FIG. 12 is a perspective diagram showing a smart trash can according to a third embodiment of the present invention.

As shown in FIG. 12, a third embodiment of the smart trash can is similar to the previous embodiment except that the present embodiment has a protection element 23 beneath the fastener member 2. In the present embodiment, the protection element 23 includes two metallic pieces that are normally separated from each other and as such are not conducted. When the fastener member 2 is lowered by the hoist member 3 and touches a user's finger, the metallic pieces deform and contact each other, and a signal may be conducted through the metallic pieces to stop the downward movement, thereby preventing the accidental harm to the user.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A smart trash can, comprising:

a can member;

a fastener member for fixing a trash bag's opening;

a hoist member inside the can member arranged along an inner lateral side of the can member;

a pump element inside a lower section of the can member;

a sensor element inside the can member for detecting whether a lower part of the trash bag has approached a bottom side of the can member;

a thermal sealing member mounted to a top opening of the can member for thermally sealing the opening of the trash bag, where the fastener member is detachably embedded in the thermal sealing member, the hoist member is joined to a bottom side of the fastener member and engages the thermal sealing member into vertical movement;

a power element on the can member; and a controller element inside the thermal sealing member electrically connected with the hoist member, the pump element, and the thermal sealing member.

2. The smart trash can according to claim 1, wherein the hoist member comprises a main shaft, a driver element coupled to and engaging the main shaft into vertical movement, and a plurality of auxiliary shafts arranged to two sides of the main shaft.

3. The smart trash can according to claim 1, wherein the thermal sealing member comprises a first sealing element arranged adjacent to the hoist member, a sliding rod perpendicular to the first sealing element, and a second sealing element opposite and parallel to the first sealing element movable along the sliding rod.

4. The smart trash can according to claim 3, wherein the thermal sealing member further comprises a motor located oppositely to the first sealing element, a first swivel arm whose back end is pivoted to and engaged by the motor, and a second swivel arm whose back end is pin-joined to a front end of the first swivel arm; the second swivel arm is coupled to the second sealing element; and an elastic element is configured at where the first swivel arm and the second swivel arm are joined.

5. The smart trash can according to claim 1, wherein the fastener member comprises a prop element, and a correspondingly shaped seal element joined to a top side of the prop element.

6. The smart trash can according to claim 1, further comprising a cover covering a top opening of the fastener member.

7. The smart trash can according to claim 6, wherein the cover is hinged to the thermal sealing member through a self-opening member.

8. The smart trash can according to claim 1, wherein a handle is provided to an outer side of the can member.

9. The smart trash can according to claim 1, wherein a vent opening is provided on the can member adjacent to the pump element.

10. The smart trash can according to claim 1, wherein a protection element is provided beneath the fastener member.

* * * * *